United States Patent [19]

Greenebaume, II

[11] Patent Number: 4,958,757

[45] **Date of Patent: * Sep. 25, 1990**

[54] FERRULE FOR SEALING WITH A CONTAINER

[75] Inventor: James E. Greenebaume, II, Highland Park, Ill.

[73] Assignee: Pittway Corporation, Cary, Ill.

[ * ] Notice: The portion of the term of this patent subsequent to Dec. 20, 2005 has been disclaimed.

[21] Appl. No.: 286,966

[22] Filed: Dec. 19, 1988

Related U.S. Application Data

[63] Continuation-in-part of Ser. No. 862,282, May 12, 1986, Pat. No. 4,813,576, which is a continuation-in-part of Ser. No. 733,207, May 13, 1985, Pat. No. 4,792,067.

[51] Int. Cl.[5] ..... B65D 83/14

[52] U.S. Cl. ..... 222/394; 222/402.1; 53/488

[58] Field of Search ... 222/394, 402.1, 402.21-402.25, 222/402.16, 402.2, 542, 1; 413/7, 42-44, 58-62; 53/470, 330, 488-489; 220/67, 81 R; 251/342, 353-354

[56] References Cited

U.S. PATENT DOCUMENTS

| | | | |
|---|---|---|---|
| 1,890,936 | 12/1932 | Douglass | 413/8 |
| 2,047,076 | 6/1936 | Kronquest | 413/6 |
| 2,676,899 | 4/1954 | Hackley | 427/374.7 |
| 2,781,077 | 2/1957 | Dovidio | 156/213 |
| 2,783,597 | 3/1957 | Hohl et al. | 53/421 |
| 2,837,375 | 6/1958 | Efford et al. | 239/337 |
| 3,036,728 | 5/1962 | Gibb | 220/75 |
| 3,081,906 | 3/1963 | Wenchert | 220/67 |
| 3,102,823 | 9/1963 | Manasia et al. | 427/185 |
| 3,342,381 | 9/1967 | Simons et al. | 222/402.1 |
| 3,417,177 | 12/1968 | Simons et al. | 264/230 |
| 3,443,006 | 6/1969 | Simons et al. | 264/249 |
| 3,512,685 | 5/1970 | Ewald | 222/396 |
| 3,562,049 | 2/1971 | Maher | 156/213 |
| 3,587,942 | 6/1971 | Gailitis | 222/402.24 |
| 3,618,817 | 5/1970 | Troughten | 220/454 |
| 3,657,044 | 4/1972 | Singer | 156/212 |
| 3,669,816 | 6/1972 | Smith et al. | 428/61 |
| 3,702,669 | 11/1973 | Ewald | 222/402.16 |
| 3,745,035 | 7/1973 | Troughton et al. | 427/181 |
| 3,893,882 | 7/1975 | Repenning | 156/287 |
| 3,898,945 | 8/1975 | Robowetz | 413/1 |

(List continued on next page.)

FOREIGN PATENT DOCUMENTS

| | | |
|---|---|---|
| 033626 | 8/1981 | European Pat. Off. . |
| 827972 | 6/1938 | France . |
| 80233 | 8/1984 | Greece . |
| 47-16307 | 1/1972 | Japan . |
| 55-24718 | 2/1980 | Japan . |
| 56-84247 | 7/1981 | Japan . |
| 8101695 | 6/1981 | PCT Int'l Appl. . |
| 463797 | 4/1937 | United Kingdom . |
| 499902 | 9/1937 | United Kingdom . |
| 478564 | 1/1938 | United Kingdom . |
| 562876 | 7/1944 | United Kingdom . |
| 908909 | 10/1962 | United Kingdom . |
| 1358334 | 3/1974 | United Kingdom . |
| 1434351 | 5/1976 | United Kingdom . |

*Primary Examiner*—Michael S. Huppert
*Attorney, Agent, or Firm*—Frijourf, Rust & Pyle

[57] ABSTRACT

An apparatus and a method is disclosed for an improved ferrule for sealing with an annular bead of a container. The ferrule comprises a peripheral rim having an inner peripheral region and an outer peripheral region. The outer peripheral region of the peripheral rim includes a portion thereof having a contour different from an outer bead surface of the annular bead of the container. The different contour portion of the outer peripheral region inhibits the inner peripheral region of the peripheral rim from fully contacting an inner bead surface of the annular bead of the container when the ferrule is disposed upon the container. The different contour portion of the outer peripheral region is deformed when the ferrule is sealed to the annular bead of the container to have substantially the same contour as the outer bead surface of the annular bead to provide a sealing engagement between the ferrule and the container.

18 Claims, 7 Drawing Sheets

U.S. PATENT DOCUMENTS

| | | | |
|---|---|---|---|
| 3,906,126 | 9/1975 | Kaiser et al. | 428/35.9 |
| 3,921,574 | 11/1975 | English | 118/106 |
| 3,921,847 | 11/1975 | Rentmeester | 220/455 |
| 3,958,727 | 5/1976 | Steiman | 222/402.24 |
| 3,999,357 | 12/1976 | Marantz | 53/442 |
| 4,000,338 | 12/1976 | Burdin | 427/184 |
| 4,003,492 | 1/1977 | Beveridge et al. | 220/62 |
| 4,034,132 | 7/1977 | Manual | 428/35.8 |
| 4,065,023 | 12/1977 | Rentneester et al. | 220/75 |
| 4,093,102 | 6/1978 | Kraska | 220/67 |
| 4,169,903 | 10/1979 | Scholes | 427/28 |
| 4,183,974 | 1/1980 | Coucher et al. | 427/28 |
| 4,271,208 | 6/1981 | Itoh et al. | 427/28 |
| 4,293,353 | 10/1981 | Pelton et al. | 156/69 |
| 4,308,973 | 1/1982 | Irland | 220/454 |
| 4,350,261 | 9/1982 | Roth | 220/270 |
| 4,353,765 | 10/1982 | Covi et al. | 156/212 |
| 4,423,823 | 1/1984 | Franek et al. | 220/77 |
| 4,448,322 | 5/1984 | Kraska | 220/67 |
| 4,538,758 | 9/1985 | Griffith | 229/4.5 |
| 4,597,512 | 7/1986 | Wilmot | 222/402.2 |
| 4,792,067 | 12/1988 | Greenebaum, II | 222/402.1 |

FERRULE FOR SEALING WITH A CONTAINER

CROSS-REFERENCE TO RELATED APPLICATIONS

This is a continuation-in-part of application Ser. No. 862,282 filed May 12, 1986 now U.S. Pat. No. 4,813,576 which is a continuation-in-part of application Ser. No. 733,207 filed May 13, 1985 now U.S. Pat. No. 4,792,067. All subject matter set forth in application Ser. Nos. 862,282 and 733,207 is hereby incorporated by reference into the present application.

BACKGROUND OF THE INVENTION

1. Field Of The Invention This invention relates to dispensing and more particularly to the dispensing of a fluid material from a container through a terminal orifice. The dispensing devices incorporating a ferrule or a closure for sealing with the container of the dispensing device.

2. Information Disclosure Statement

Aerosol containers and aerosol mounting cups have been so well known and so well established in the prior art that the basic shape and the basic dimensions of the aerosol containers and the mounting cups are standard in the aerosol industry. In the aerosol industry, an aerosol container is typically made of tin plated steel or aluminum and is provided with an opening in the container encircled by an annular bead for sealing with a peripheral rim formed in the mounting cup. The mounting cup receives an aerosol valve assembly for providing fluid communication between the interior of the aerosol container and the exterior of the aerosol container upon activation of the aerosol valve assembly by a user. The prior art has produced various types of aerosol valves, aerosol valve mechanisms, aerosol dispensing buttons, aerosol dispensing spouts, aerosol overcaps, and various other aerosol dispensing mechanisms for use with a variety of aerosol products as should be well known among those skilled in the art.

The aerosol valve mechanism and the mounting cup is typically fabricated at a valve assembly plant and shipped to a filling plant whereat the valve mechanism and mounting cup is sealed to the aerosol container with the aerosol product and the propellant retained therein. The mounting cup has a peripheral rim which is capable of being crimped to an annular bead located on the aerosol container to establish a seal between the mounting cup and the aerosol container. A plastic or rubber sealing material is located on the peripheral rim of the mounting cup for insuring the sealing engagement between the peripheral rim of the mounting cup and the annular bead of the aerosol container. The peripheral rim of the mounting cup is formed in a substantially inverted U-shaped configuration with the sealing material located in an interior space of the inverted U-shaped peripheral rim. The peripheral rim of the mounting cup is placed upon the annular bead of the aerosol container with the sealing material disposed therebetween. The mounting cup is then deformed or crimped by an expanding collet to bring the peripheral rim of the mounting cup into sealing engagement with the annular bead of the aerosol container.

In the past, numerous sealing materials and sealing devices have been proposed by the prior art for enhancing the seal between the peripheral rim of the mounting cup and the annular bead of the aerosol container. One of the first sealing materials utilized was a cured in place sealing material wherein a liquid sealing material was applied to an interior surface of the peripheral rim of the mounting cup. The liquid sealing material was passed through a sequence of ovens to evaporate the volatile solvents from the liquid sealant material and to cure the sealant material thereby leaving a resilient residue on the interior surface of the peripheral rim for providing a fluid tight seal when the peripheral rim of the mounting cup was crimped to the annular bead of the aerosol container.

Others in the prior art have utilized mounting cups formed from a metallic sheet material which had been precoated or laminated with a plastic sealing material. As the mounting cup was formed from the laminated plastic and metallic sheet material, the laminated plastic sealing material was located within the peripheral rim of the mounting cup to provide a seal when the mounting cup was secured or crimped to the aerosol container.

Another proposal in the prior art for a mounting cup sealing material was the use of a preformed sleeve of plastic material which was inserted onto the peripheral rim of the mounting cup. The preformed sleeve of plastic material is set forth in the published European Patent Application under Ser. No. 0,033,626.

Another proposal in the prior art for a mounting cup sealing material is set forth in the Patent Cooperation Treaty Published Patent Application Ser. No. PCT/US83/01463 wherein a heated mounting cup was immersed within a vessel containing plastic particulate material. A thin coating of the plastic particulate material was thereby affixed to the heated mounting cup. The mounting cup with the affixed thin coating of the plastic particulate material was then removed from the vessel and was heated to produce a uniform coating of plastic sealing material on the interior surface of the peripheral rim of the mounting cup.

Although various proposals have been made in the prior art to improve the seal between the peripheral rim of the mounting cup and the annular bead of the aerosol container, little or no effort has been undertaken to improve the shape or configuration of the mounting cup. The seal between the peripheral rim of the mounting cup and the annular bead of the aerosol container remains of great concern to both the valve assembly plants and the filling plants since the seal between the mounting cup and the aerosol container must be capable of being gas tight for a period of years. In addition, the seal between the mounting cup and the aerosol container must be low in cost to enable aerosol products to be competitive with non- aerosol products in the consumer market.

The problem is further complicated by the fact that the various sealing materials namely, the cured in place sealing material, the plastic sleeve material, the laminated plastic sealing material, and the plastic particulate sealing material all have different thickness which may vary beyond the normal tolerances of the mounting cup and the annular bead of the aerosol container. Furthermore, although quality control is paramount in the aerosol industry, the peripheral rims of the mounting cups manufactured by the valve assembly plants and the annular beads of the aerosol container manufactured by container plants have nominal variations which are within quality control limits. In some cases, the difference in thickness of the plastic sealing materials and the nominal variations of the peripheral rims of the mounting cups and/or the annular beads of the containers are compounded to produce a defective seal in a completed aerosol product which may remain undetected until discovered by the ultimate consumer.

Accordingly, it should be realized that the seal between the mounting cup and the aerosol container is of prime importance to the aerosol industry. Furthermore, since the size and the shape of the annular bead of the aerosol container and the size and the shape of the mounting cup have been virtually unchanged for more than twenty years, it is not surprising that substantially all of the effort to enhance the seal between the mounting cup and the aerosol container has been directed to the sealing material located between the aerosol container and the mounting cup.

Aerosol containers and aerosol mounting cups have been so well known and so well established in the prior art that the basic shape and the basic dimensions of the aerosol containers and the mounting cups are standard in the aerosol industry. In the aerosol industry, an aerosol container is typically made of tin plated steel or aluminum and is provided with an opening in the container encircled by an annular bead for sealing with a peripheral rim formed in the mounting cup. The mounting cup receives an aerosol valve assembly for providing fluid communication between the interior of the aerosol container and the exterior of the aerosol container upon activation of the aerosol valve assembly by a user. The prior art has produced various types of aerosol valves, aerosol valve mechanisms, aerosol dispensing buttons, aerosol dispensing spouts, aerosol overcaps, and various other aerosol dispensing mechanisms for use with a variety of aerosol products as should be well known among those skilled in the art.

The aerosol valve mechanism and the mounting cup is typically fabricated at a valve assembly plant and shipped to a filling plant whereat the valve mechanism and mounting cup is sealed to the aerosol container with the aerosol product and the propellant retained therein. The mounting cup has a peripheral rim which is capable of being crimped to an annular bead located on the aerosol container to establish a seal between the mounting cup and the aerosol container. A plastic or rubber sealing material is located on the peripheral rim of the mounting cup for insuring the sealing engagement between the peripheral rim of the mounting cup and the annular bead of the aerosol container. The peripheral rim of the mounting cup is formed in a substantially inverted U-shaped configuration with the sealing material located in an interior space of the inverted U-shaped peripheral rim. The peripheral rim of the mounting cup is placed upon the annular bead of the aerosol container with the sealing material disposed therebetween. The mounting cup is then deformed or crimped by an expanding collet to bring the peripheral rim of the mounting cup into sealing engagement with the annular bead of the aerosol container.

Therefore, it is an object of the present invention to provide an improved ferrule for sealing with a container of a dispensing device wherein the peripheral rim of the ferrule comprises an improved outer region contour which is deformed when the ferrule is crimped to the annular bead of the container.

Another object of this invention is to provide an improved ferrule for sealing with a container of a dispensing device wherein the improved outer region contour of the peripheral rim of the ferrule allows only a portion of the peripheral rim to contact the annular bead of the container when the ferrule is disposed on the container and which outer region contour of the peripheral rim is reformed to be substantially the same shape as the contour of the annular bead when the ferrule is crimped to the container.

Another object of this invention is to provide an improved ferrule for sealing with a container of a dispensing device wherein the improved outer region contour of the peripheral rim of the ferrule adjusts for variations in the dimensions in the ferrule peripheral rim and adjusts for variations in the dimensions in the annular bead of the container to provide a superior seal therebetween.

Another object of this invention is to provide an improved ferrule for sealing with a container of a dispensing device which is suitable for use with a cured in place sealing material, a preformed plastic sleeve material, a laminated sealing material, a plastic particulate sealing material and all other types of sealing materials used in the dispensing industry.

Another object of this invention is to provide an improved ferrule for sealing with a container of a dispensing device which comprises a new ferrule shape prior to the crimping process but which has a conventional ferrule shape subsequent to the crimping and sealing of the peripheral rim of the ferrule to the annular rim of the container.

Another object of this invention is to provide an improved ferrule for sealing with a container of a dispensing device wherein the improved ferrule may be used with conventional crimping equipment in the dispensing industry.

Another object of this invention is to provide an improved ferrule for sealing with a container of a dispensing device wherein the peripheral rim of the improved ferrule has an initial shape substantially different from the shape of the annular bead of the container and which peripheral rim is reformed during the crimping process to have substantially the same shape as the annular bead of the container.

Another object of this invention is to provide an improved ferrule for sealing with a container of a dispensing device which is suitable for use with all existing aerosol valves.

Another object of this invention is to provide an improved ferrule for sealing with a container of an aerosol device wherein the improved ferrule provides a superior seal independent of the sealing material without any additional cost in the fabrication of the ferrule.

Another object of this invention is to provide an improved method for forming a seal between a ferrule and a container of an aerosol device wherein the crimping of the ferrule reforms the peripheral rim of the ferrule to be substantially the same shape as the contour of the annular bead of the aerosol container to provide a sealing engagement between the ferrule and the aerosol container.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in con junction with the accompanying drawings.

SUMMARY OF THE INVENTION

The present invention is defined by the appended claims with specific embodiments being shown in the attached drawings. For the purpose of summarizing the invention, the invention relates to an improved ferrule for sealing with a container of an aerosol device, the container having an annular bead extending about an opening in the container and with the annular bead having inner and outer surface contours. The invention comprises a ferrule having a peripheral rim for sealing with the annular bead of the container. The peripheral rim has an outer region contour being substantially different in shape from the outer surface contour of the annular bead of the container. The difference in the shape of the outer region contour of the peripheral rim from the shape of the outer surface contour of the annular bead allows only a portion of the outer region contour of the peripheral rim to contact the outer surface contour of the annular bead when the ferrule is first disposed on the container. The shape of the outer region contour of the peripheral rim is deformed when the ferrule is crimped to the annular bead of the container. The deformation of the outer region contour reforms to the shape of the outer region contour to be substantially the same shape as the outer surface contour of the annular bead to provide a sealing engagement between the ferrule and the container.

In a more specific embodiment of the invention, the ferrule is preferably formed of a material which is substantially more ductile than the material forming the annular bead of the container. Preferably, a sealing material is secured to the inner region contour of the peripheral rim for sealing any voids between the inner region contour of the peripheral rim and the outer surface contour of the annular bead when the ferrule is crimped to the container.

In one embodiment of the invention, the outer surface contour of the annular bead comprises an outer bead surface and an inner bead surface with the outer bead surface being established substantially normal to the inner bead surface. The outer region contour of the peripheral rim has a bevel or a generally flattened (straight) or slightly curved cross-section for allowing only a circular portion of the outer region contour of the peripheral rim to contact the outer bead surface of the annular bead when the ferrule is disposed on the container.

The crimping of the ferrule to the annular bead includes the enlargement of the bevel of the peripheral rim adjacent the annular bead to deform the outer region contour of the peripheral rim against the outer surface contour of the annular bead whereby the outer region contour of the peripheral rim is reformed into the shape of the outer surface contour of the annular bead and is established into sealing engagement therewith.

The invention is also incorporated into the method of forming a seal between a ferrule and a container of an aerosol dispensing device. The container has an annular bead extending about an opening in the container with the annular bead having an inner surface contour. The method includes firstly, forming a peripheral rim in the ferrule with the peripheral rim having an outer region contour being substantially different in shape from the outer surface contour of the annular bead of the container. Secondly, the peripheral rim of the ferrule is placed on the annular bead of the container. Thirdly, the ferrule is forced downward against the sealing material and against the annular bead. Fourthly, the ferrule is bent under the annular bead while the flattened section of the ferrule is reformed to the outer region contour of the peripheral rim so as to be substantially the same shape as the outer surface contour of the annular bead to provide a sealing engagement between the ferrule and the container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
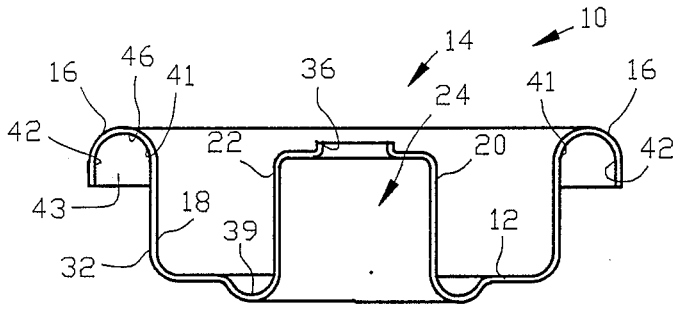
FIG. 1 PRIOR ART
FIG. 1 is a side sectional view of a prior art mounting cup for an aerosol dispensing device.

FIG. 1 is a side sectional view of a prior art mounting cup having a substantially flat base 12 disposed in a central area 14 with a peripheral rim 16 being integrally connected to the base 12 by a sidewall 18. The mounting cup 10 is shown including a mounting cup turret 20 formed in the central area 14 of the mounting cup 10. The mounting cup turret 20 is formed by sidewalls 22 for defining an interior cavity 24 of the turret 20 for accommodating an aerosol valve assembly 26 shown in FIGS. 2 and 3. The aerosol valve assembly 26 is crimped to the mounting cup 10 by crimps 28 with a valve body 30 of the aerosol valve assembly 26 being sealed to an internal surface 32 of the mounting cup 10 by a gasket 34. The mounting cup turret 20 also includes a valve stem orifice 36 for enabling a valve stem 38 to extend therethrough to provide fluid communication between the interior and the exterior of the aerosol device. An optional annular lip 39 is included for providing additional material to the mounting cup 10 when the mounting cup 10 is crimped to an aerosol container 40 as will be described in greater detail hereinafter. The aerosol valve assembly 26 is shown in FIGS. 2 and 3 without a valve button or an overcap but the operation of the aerosol valve assembly 26 should be well known to those skilled in the art and for the sake of clarity will not be further explained herein.

The peripheral rim 16 of the prior art mounting cup 10 is substantially an inverted U-shape having an inner region contour 41 and an outer region contour 42 which are generally partially circular in configuration defining an internal space 43 for receiving an annular bead 44 of the aerosol container 40 therein. The interior surface 32 of the mounting cup 10 in this embodiment is provided with a sealing material 46 for providing a fluid-tight seal between the peripheral rim 16 and the annular bead 44 of the aerosol container 40.

Figure 2:
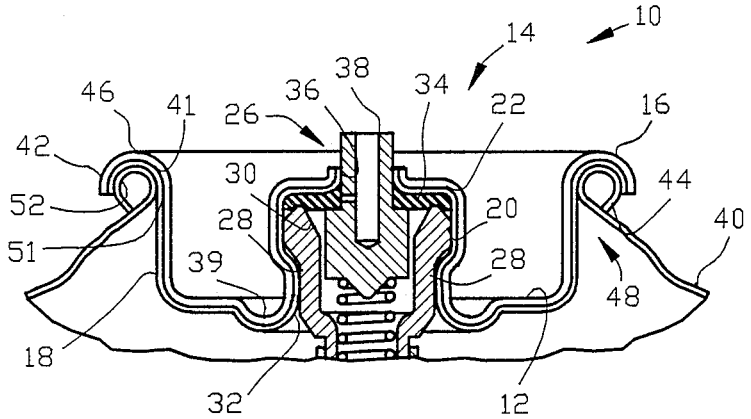
FIG. 2 PRIOR ART
FIG. 2 is a side sectional view of an aerosol dispensing mechanism including the prior art mounting cup shown in FIG. 1 disposed upon an aerosol container.
Figure 3:
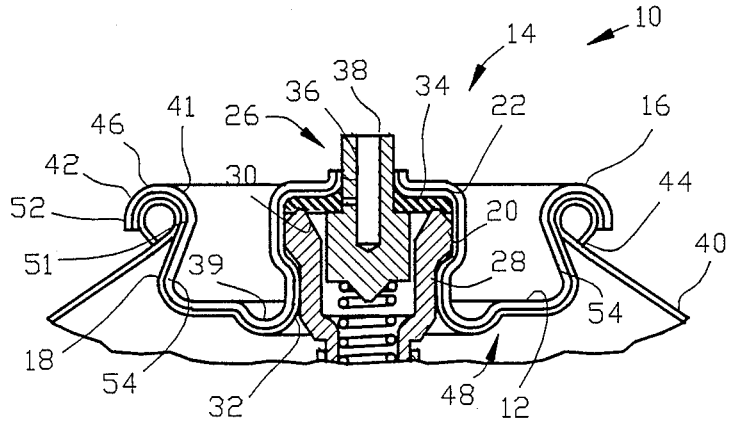
FIG. 3 PRIOR ART
FIG. 3 is a side sectional view of the aerosol dispensing mechanism including the prior art mounting cup shown in FIG. 1 secured to the aerosol container.

The annular bead 44 extends about an opening 48 in the aerosol container 40 with the annular bead 44 being rolled into the configuration as shown in FIGS. 2 and 3 thereby defining an inner surface contour 51 proximate the opening 48 of the aerosol container 40 and an outer surface contour 52 remote from the opening 48 in the aerosol container 40. The annular bead 44 has a generally circular cross-section such that the inner surface contour 51 and the outer surface contour 52 are partially circular in cross-section as shown in FIGS. 2 and 3. In the prior art mounting cup 10, the inner region contour 41 and the outer region contour 42 has a radius of curvature substantially equal to the radius of curvature of the inner surface contour 51 and the outer surface contour 52, respectively, to enable the internal space 43 of the peripheral rim 16 to fully receive the annular bead 44. The annular bead 44 is typically constructed of a type T-2 or type T-3 tin-coated steel whereas the mounting cup 10 is made of a more ductile material such as type D T-1 tin-plated steel.

FIG. 2 illustrates the prior art mounting cup 10 being disposed upon the annular bead 44 of the aerosol container 40. As it can be clearly seen from FIG. 2, the inner region contour 41 and the outer region con tour 42 of the peripheral rim 16 of the mounting cup 10 respectively engage the inner surface contour 51 and the outer surface contour 52 of the annular bead 44 of the aerosol container 40. In addition, virtually the entire internal space 43 of the peripheral rim 16 is occupied by the annular bead 44 of the container 40. Accordingly, in the prior art mounting cup 10, the inner region contour and the outer region contour 41 and 42 were specifically formed to fit with the inner surface contour and the outer surface contour of 51 and 52 of the annular bead 44 and to minimize any voids within the internal space 43.

FIG. 3 illustrates prior art mounting cup 10 secured to the aerosol container 40. The sidewall 18 of the mounting cup 10 is deformed by an expansion collet (not shown) to produce a mounting cup crimp 54 adjacent the annular bead 44 of the aerosol container 40 to provide a sealing engagement between the mounting cup 10 and the aerosol container 40.

The prior art mounting cup 10 has been formed in the shape as shown in FIGS. 1–3 for many decades since it was believed that a contacting fit as shown in FIG. 2 was the most advantageous to create a seal between the peripheral rim 16 and the annular bead 44. Accordingly, the majority of efforts of the prior art to improve the seal between the mounting cup 10 and the aerosol container 40 were concentrated into improving the sealing material 46 between the peripheral rim 16 and the annular bead 44.

Figure 4:
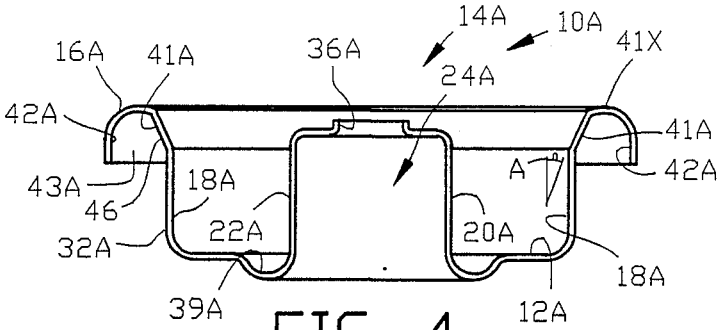
FIG. 4 is a side sectional view of a first embodiment of an improved mounting cup of the present invention.
Figure 5:
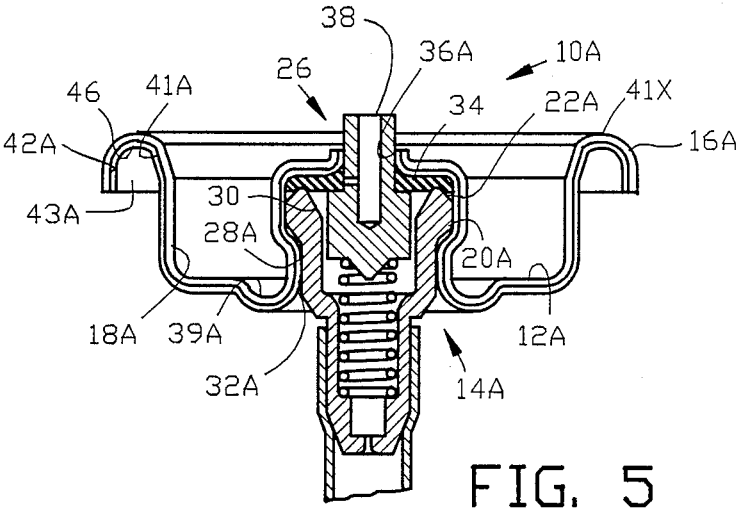
FIG. 5 is a side sectional view of an aerosol dispensing mechanism including the improved mounting cup of FIG. 4.

FIG. 4 is a side sectional view of a first embodiment of a mounting cup 10A of the present invention comprising a substantially flat central base 12A disposed in a central area 14A with a peripheral rim 16A being integrally connected to the base 12A by a sidewall 18A. The mounting cup 10A is shown including a mounting cup turret 20A formed in the central area 14A of the mounting cup 10A. The mounting cup turret 20A is formed by sidewalls 22A for defining an interior cavity 24A of the turret 20A for accommodating the aerosol valve assembly 26 shown in FIGS. 5–8. The aerosol valve assembly 26 is identical to the aerosol valve assembly 26 shown in FIGS. 2 and 3 but it should be understood that any valve assembly incorporating a mounting cup or any valveless mounting cup is suitable for use with the present invention. The aerosol valve assembly 26 is crimped to the mounting cup 10A by crimps 28A with the valve body 30 of the aerosol valve assembly 26 being sealed to an interior surface 32A of the mounting cup 10A by a gasket 34. The mounting cup turret 20A also includes a valve stem orifice A for enabling the valve stem 38 to extend therethrough to provide fluid communication between the interior and the exterior of the aerosol device. An optional annular lip 39A is included for providing additional material to the mounting cup A when the mounting cup is crimped to the aerosol container 40.

The peripheral rim 16A of the improved mounting cup 10A has an inner region contour 41A and an outer region contour 42A defining an interior space 43A for cooperating with the annular bead 44 of the aerosol container 40. In this embodiment the interior surface of the mounting cup 32A is provided with a sealing material 46 for defining the inner region contour 41A and the outer region contour 42A and to provide a fluid-tight seal between the peripheral rim 16A and the annular bead 44 of the aerosol container 40.

The outer region contour 42A of the peripheral rim 16A of the improved mounting cup 10A is generally partially circular in cross-section in a manner similar to the outer region contour 42 of the peripheral rim 16 of the prior art mounting cup 10 shown in FIGS. 1–3. In addition, the outer region contour 42A of the peripheral rim 16A has a radius of curvature substantially equal to the radius of curvature the outer surface con tour 52 of the annular bead 40.

As can be clearly seen from FIG. 4, the inner region contour 41A of the peripheral rim 16A of the improved mounting cup 10A is substantially different in shape from the inner surface contour 51 of the annular bead 44. The inner region contour 41A of the peripheral rim 16A of the improved mounting cup 10A shown in FIG. 4, extends into the interior space 43 normally defined by the peripheral rim 16 of the prior art mounting cup 10 shown in FIG. 1. In the embodiment shown in FIG. 4, the inner region contour 41A comprises a flattened annular surface having a substantially linear cross-section and angularly disposed relative to the side wall 18A of the mounting cup 10A. The substantially linear region forms an angle A of approximately 30 degrees relative to the sidewall 18A. Since the inner region contour 41A is shown as a linear tapered region, the radius of curvature of the inner surface region 41A is infinite but it should be understood that the inner surface contour 41A may be slightly curved about a large radius of curvature or may be convexly curved into the interior space 43A of the peripheral rim 16A to accomplish the intend ed purpose of the invention.

Figure 6:
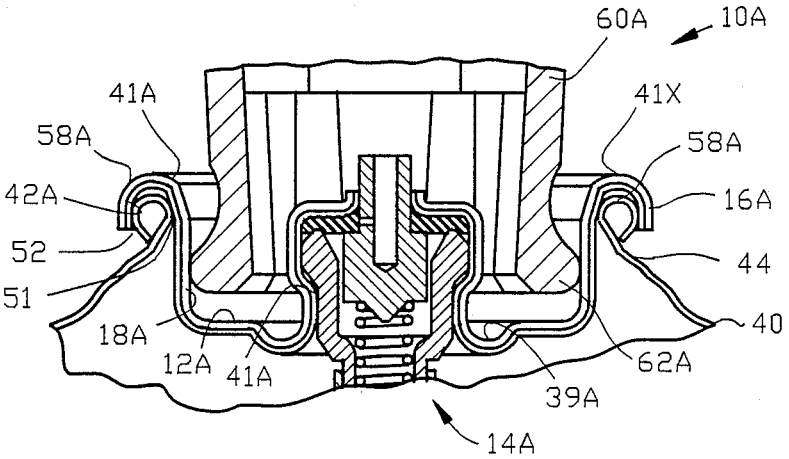
FIG. 6 is a side sectional view of the aerosol dispensing mechanism including the improved mounting cup of FIG. 4 being disposed upon an aerosol container.

In a manner identical to FIGS. 2 and 3, the annular bead 44 shown in FIG. 6 extends about an opening 48 in the aerosol container 40 with the annular bead 44 having an inner surface contour 51 proximate the opening 48 of the aerosol container 40 and an outer surface contour 52 remote from the opening 48 in the aerosol container 40. The annular bead 44 has a generally circular cross-section such that the inner surface contour 51 and the outer surface contour 52 are generally partially circular in cross-section as shown in FIGS. 5–8.

FIG. 6 illustrates the mounting cup 10A being disposed upon the aerosol container 40 with the peripheral rim 16A engaging the annular bead 44. As it can be clearly seen from FIG. 6, the inner region contour 41A forms an interference fit with the inner surface contour 51 to inhibit the complete seating of the mounting cup 10A on the annular bead 44 in contrast to the prior art shown in FIG. 2. The inner region contour 41A of the peripheral rim 16A allows only a portion of the inner region con tour 41A to contact the inner surface contour 51 of the annular bead 44. Accordingly, only a circular portion of the inner region contour 41A of the peripheral rim 16A contacts the inner surface contour 51 of the annular bead when the mounting cup 10A is disposed on the aerosol container 40. Furthermore, the internal space 43A of the improved mounting cup 10A does not fully receive the annular bead 44 as the prior art mounting cup 10. In contrast to the prior art mounting cup 10, a void 58A is created between the peripheral rim 16A and the annular bead 44 as shown in FIG. 6. The interference fit between the inner region contour 41A and the inner surface contour 51 prohibits a rim apex 41X located at the intersection of the inner region contour 41A and the outer region contour 42A from contacting a bead apex 51X located at the intersection of the inner surface contour 51 and the outer surface contour 52.

FIG. 6 also illustrates an expandable collet 60A having an annular collet head 62A for crimping the mounting cup 10A into sealing engagement with the aerosol container 40. The internal space 43 of the peripheral rim 16 of the prior art mounting cup 10 completely received the annular bead 44 as shown in FIG. 3 and was believed to provide the proper seating of the peripheral rim 16 on the annular bead 44 prior to the crimping process. The internal space 43A of the peripheral rim 16A of the mounting cup 10A of the present invention does not completely receive the annular bead 44 as shown in FIG. 6 prior to the crimping process. In view of the improved inner region contour 41A of the peripheral rim 16A of the present invention inhibiting the complete reception of the annular bead 44, one would expect that an improper seal would be created between the improved mounting cup 10A and the aerosol container 40. However, in contrast to what one would expect, the use of the improved inner region contour 41A to inhibit the peripheral rim 16A from completely receiving the annular bead 44 as shown in FIG. 6 produces an enhanced and more reliable seal than heretofore known in the art.

Figure 7:
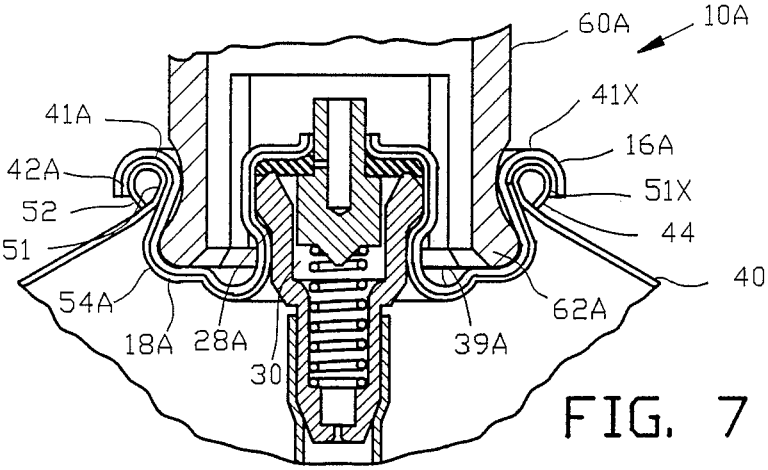
FIG. 7 is a side sectional view of the aerosol dispensing mechanism including the improved mounting cup of FIG. 4 being secured to the aerosol container.

FIG. 7 is a side sectional view illustrating the sealing engagement between the inner region contour 41A of the peripheral rim 16A of the mounting cup 10A and the annular bead 44 of the aerosol container 40. In this embodiment, the expandable collet 60A has been moved radially outwardly for enabling the annular collet head 62A to form a crimp 54A in the sidewall 18A of the mounting cup 10A. Simultaneously therewith, the expandable collet head 62A has reformed the inner region contour 41A to approximate the generally partial circular cross-section of the inner surface contour 51 of the annular bead 44. As the inner region contour 41A of the peripheral rim 16A is reformed into conformity with the inner surface contour 51 of the annular bead 44, the mounting cup 10A is brought into sealing engagement with the aerosol container 40. During the de forming process, the base 12A of the mounting cup 10A is raised in FIG. 7 to provide additional material to form the crimp 54A. Simultaneously therewith, the inner region contour 41A is drawn downwardly in FIG. 7 to a position whereat the inner region contour 41A of the mounting cup 10A provides a mating engagement with the inner surface contour 51 of the annular bead 44. The deformation of the mounting cup 10A during crimping reforms the inner region contour 41A over the surface of the inner surface contour 51B and moves the rim apex 41X into close proximity or contact with the bead apex 51X.

Figure 8:
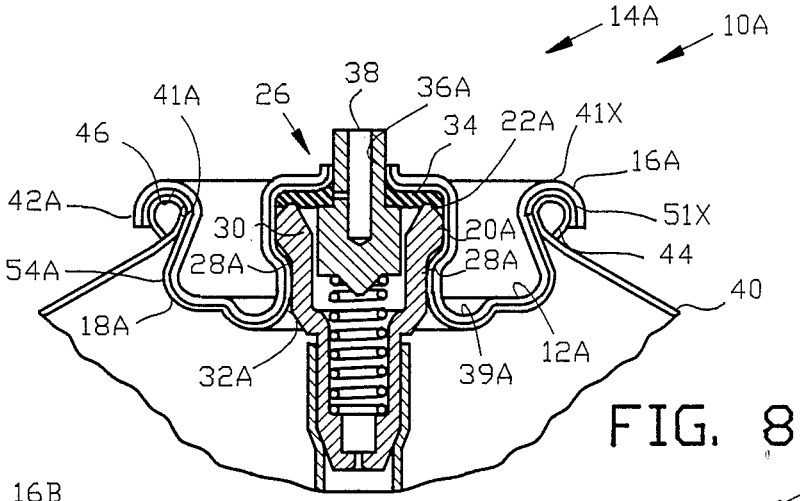
FIG. 8 is a side sectional view of the completed aerosol device with the aerosol dispensing mechanism of FIG. 5 shown secured to the aerosol container.

After formation of the crimp 54A shown in FIG. 7, the collet heads 62A are moved radially inwardly to a position as shown in FIG. 6 and are removed to provide the finished aerosol dispensing device as shown in FIG. 8. As it can be seen from an examination of FIGS. 3 and 8, the outward appearance of the peripheral rim 16A of the improved mounting cup 10A of the present invention is substantially the same as the outward appearance of the peripheral rim 16 of the prior art mounting cup 10. Accordingly, after crimping of the improved mounting cup 10A, the mounting cup 10A appears to be identical to the prior art mounting cup 10 to the casual observer.

In the prior art process, the peripheral rim 16 of the mounting cup 10 is positioned for complete contact with the annular bead 44 as shown in FIG. 2. In the event of a significant variation in the size or the shape of the peripheral rim 16 and/or the annular bead 44, a void is produced between the peripheral rim 16 and the annular bead 44. During the crimping of the prior art mounting cup 10, there is only little downward movement of the inner region contour 41 of the peripheral rim 16 relative to the annular bead 44 in FIG. 2. Thus leaks may develop between the peripheral rim 16 and the annular bead 44 at the point or points of the significant variation in the size or the shape of the peripheral rim 16 and/or the annular bead 44.

In the improved mounting cup 10A of the present invention, the inner region contour 41A of the peripheral rim 16A inhibits the peripheral rim 16A from completely contacting the annular bead 44 in contrast to the prior art mounting cup 10. Accordingly, during the crimping of the improved mounting cup 10A, there is significant downward movement of the inner region contour 41A of the peripheral rim 16A relative to the annular bead 44. The inner region contour 41A is drawn downwardly in FIG. 7 during the deformation process to a position whereat the inner region contour 41A is brought into tight engagement with the annular bead 44. The deformation process of the improved mounting cup 10A compensates for any variations in the size or the shape of the peripheral rim 16A and/or the annular bead 44 since the entire inner region contour 41A is selectively deformed during the crimping process. Accordingly, the peripheral rim 16A may be deformed to a greater degree or a lesser degree at the point or points of the significant variation in the size or the shape of the peripheral rim 16A and/or the annular bead 44. In contrast, the prior art sealing process relied on a complete and uniform contact of the peripheral rim 16 of the mounting cup 10 to the annular bead 44 prior to the crimping process as shown in FIG. 2. Thereafter, the prior art mounting cup was uniformly crimped without regard for any significant variation in the size or the shape of the peripheral rim 16 and/or the annular bead 44. The inner region contour 41A of the peripheral rim 16A functions as a wedge during the crimping process whereby the expandable collet head 62A will deform and draw down the peripheral rim 16A of the mounting cup 10A into sealing engagement with the annular bead 44 of the container 40. During the crimping process, the annular bead 44 of the container 40 functions as a fulcrum to reform the inner region contour 41A of the peripheral rim 16A. After the crimping process is completed, the inner region contour 41A remains in tight intimate contact with the annular bead 44 of the container 40 regardless of any nominal manufacturing variations that may be present in the peripheral rim 16A and/or the annular bead 44 of the container 40.

The present invention has been found useful with virtually any presently available aerosol valve dispensing devices incorporating a mounting cup as well as numerous types of cans or containers having an annular bead 44. The present invention also provides superior seals on containers constructed of different types of materials including but not limited to ferrous and nonferrous metals.

Figure 9:
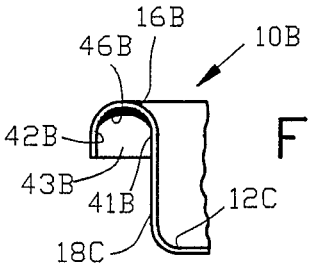
FIG. 9 is a side sectional view of a second embodiment of the improved mounting cup of the present invention.

FIG. 9 is a side sectional view of a portion of the improved mounting cup 10B wherein the inner region contour 41B is shown as a curve having a radius of curvature greater than the radius of curvature of the outer region contour 42B. In addition, FIG. 9 illustrates the use of a cured in place sealing material 46B as heretofore described.

Figure 10:
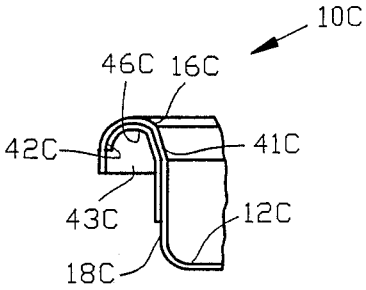
FIG. 10 is a side sectional view of a third embodiment of the improved mounting cup of the present invention.

FIG. 10 is a side sectional view of a portion of the improved mounting cup 10C wherein the inner region contour 41C is a curved surface which convexly extends into the internal space 43C of the peripheral rim 16C.

Figure 11:
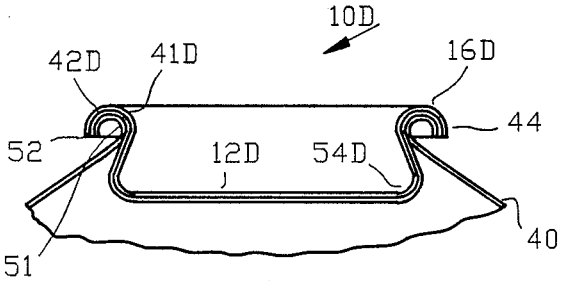
FIG. 11 is a side sectional view of a fourth embodiment of the improved mounting cup of the present invention shown secured to an aerosol container.

FIG. 11 is a side sectional view illustrating the invention being applied to a valveless mounting cup 10D. The nature and use of the valveless mounting cup 10D should well known to those skilled in the art.

Figure 12:
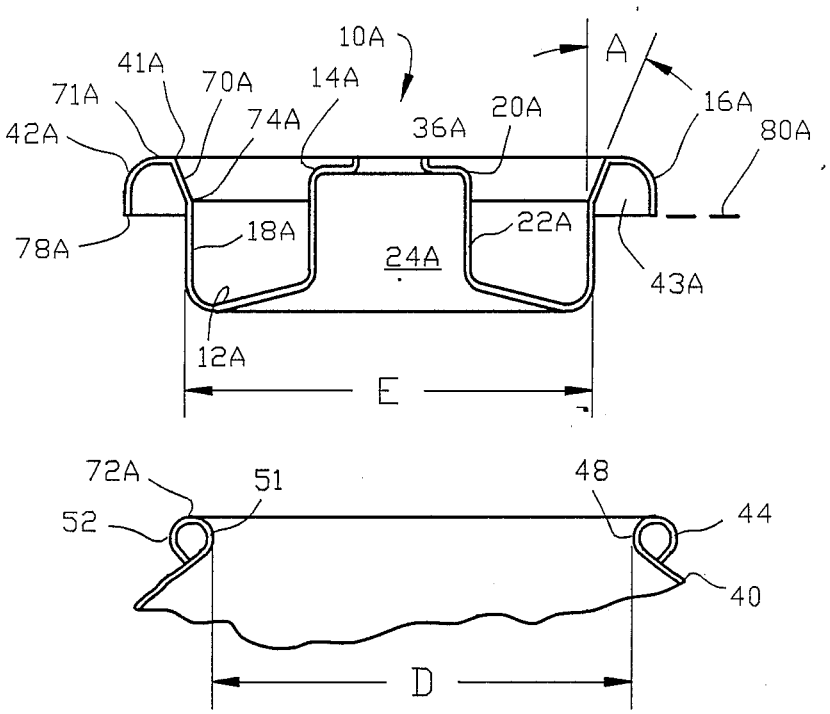
FIG. 12 is an enlarged side sectional view of the first embodiment of an improved mounting cup of the present invention showing an angle of thirty degrees.

FIG. 12 is a side sectional view of the preferred embodiment of the invention shown in FIGS. 6–8. The annular bead 44 of the aerosol container 40 defines the opening 48 of the aerosol container 40 which opening has an inner diameter D which diameter is typically is 1.000 inches in the United States. The sidewall or outer periphery 18A of the improved mounting cup 10A is typically established in the industry to have an outer diameter E between 0.992 inches and 0.994 inches. The outer diameter E of the sidewall 18A is smaller than the inner diameter D of the opening 48 in the aerosol container 40 for enabling the introduction of propellant into the aerosol container 40 between the outer diameter E of the sidewall 18A and the inner diameter D of the opening 48 in the aerosol container 40 when the mounting cup 10A is placed over the aerosol container 40 as should be well known to those skilled in the art. Angle A of a linear portion 70A of inner region contour 41A is established at 30 degrees relative to the sidewall 18A. A linear portion 70A of the inner region contour 41A is expanded radially outwardly of the outer diameter E of the sidewall 18A to provide a diameter equal to or greater to the inner diameter D of the opening 48 in the aerosol container 40. When the improved mounting cup 10A is moved downwardly onto the aerosol container 40, the radially expanded linear portion 70A of the inner region contour 41A of the peripheral rim 16A contacts the inner surface contour 51 of the annular bead 44 of the aerosol container 40. As it can be clearly seen from FIG. 6, an interference fit occurs between the inner region contour 41A and the inner surface contour 51 prior to a central area or apex 71A of the peripheral rim 16A contacting a central area or apex 72A of the annular bead 44. Accordingly, the outer diameter E of the sidewall 18A is of a size to enable the flow of propellant between the outer diameter E of side wall 18A and the inner diameter D of the opening 48 whereas the inner region contour 41A has an outer diameter which is equal to or greater to the inner diameter D of the annular bead 44 to provide the interference fit therebetween. The interference fit between the inner region contour 41A and the inner surface contour 51 is believed in part to produce the superior seals produced by the present invention.

Figure 13:
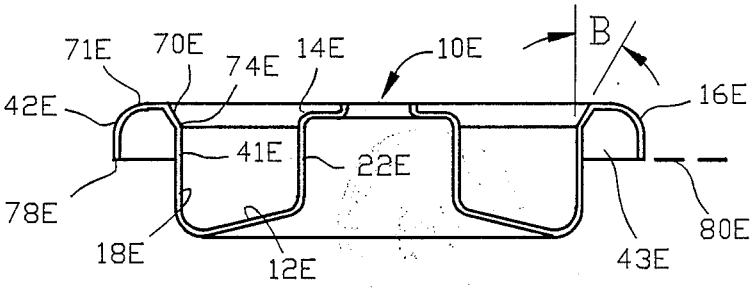
FIG. 13 is an enlarged side sectional view of a variation of the first embodiment of the improved mounting cup of the present invention showing an angle of forty-five degrees.

FIG. 13 illustrates a variation of the first embodiment wherein the angle B of a linear portion 70E of the inner region contour 41E is established at 45 degrees relative to the sidewall 18E. A termination 74E of the linear portion 70E is located at a higher level relative to the level of the termination 74A of the linear portion 70A of the inner region contour 41A of the embodiment shown in FIG. 12.

Figure 14:
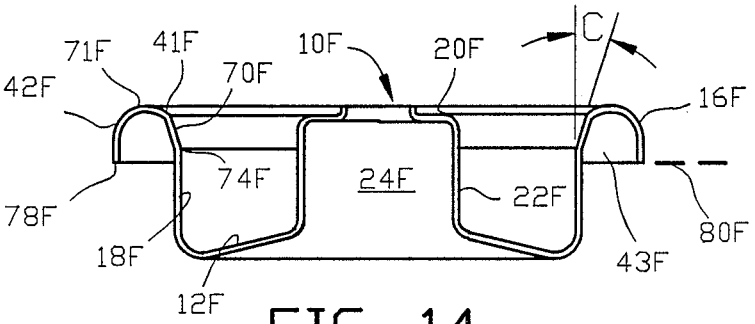
FIG. 14 is an enlarged side sectional view of another variation of the first embodiment of the improved mounting cup of the present invention showing an angle of ten degrees.

FIG. 14 illustrates a further variation of the embodiment shown in FIG. 12 wherein the angle C of the linear portion 70F is established at 10 degrees relative to the sidewall 18F. In this embodiment, the termination 74F of the linear region 70F is disposed along a plane 80F extending through the outer termination 78F of the outer surface contour 42F of the peripheral rim 16F.

Extensive tests have been preformed on the mounting cups set forth herein in an attempt to define the critical parameters of operation. All of the mounting cups shown in the present specification have been demonstrated to have substantially less leakage when compared to standard mounting cups using identical sealing materials. It is believed that one of the critical parameters for the operation of the mounting cup is that the outer diameter E of the sidewall 18A is less than the inner diameter D of the opening 48 of the annular bead 44 to enable the introduction of propellant therebetween. Furthermore, the inner region contour 41A which extends between the central area 71A and the plane 80A extending through the outer terminals 78A has at least a portion thereof with a diameter greater than the outer diameter D of the sidewall 18A to enable the intimate contact with the inner surface contour 51 of the annular bead 44 when the mounting cup 10A is placed upon the aerosol container 40. This permits the introduction of the propellant between the inner diameter D of the opening 48 and the outer diameter E of the sidewall 18A when the mounting cup 10A is slightly elevated relative to the annular bead 44 while simultaneously permitting intimate contact between the inner region contour 41A and the inner surface contour 51 of the aerosol container when the mounting cup 10A is positioned on the annular bead 44. It should be appreciated that other variations of the embodiments specified herein may be resorted to for accomplishing the same or similar inventive concept which has produced a vastly superior seal which was heretofore unknown in the prior art.

Figure 15:
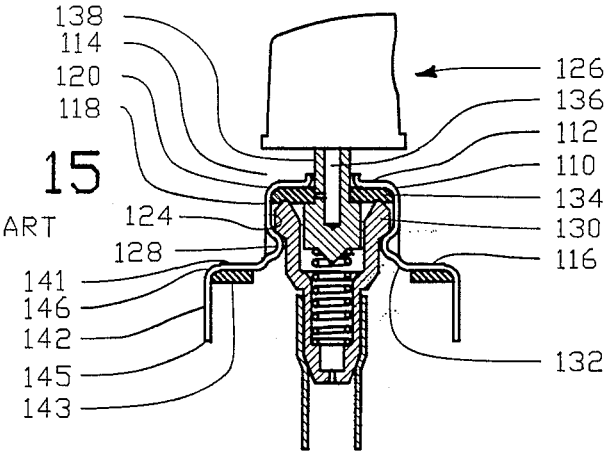
FIG. 15 PRIOR ART
FIG. 15 is a side sectional view of a prior art ferrule and ferrule valve.

FIG. 15 is a side sectional view of a prior art ferrule 110 having a substantially flat top 112 disposed in a central region 114 with a peripheral rim 116 being integrally connected to the top 112 by a sidewall 118. The ferrule 110 includes a ferrule turret 120 formed in the central region 114 of the ferrule 110. The ferrule turret 120 is formed by the sidewall 118 and defines an interior cavity 124 of the turret 120 for accommodating a dispensing device 126 shown as an aerosol valve assembly. The dispensing device 126 is crimped to the ferrule 110 by crimps 128 with a valve body 130 of the dispensing device 126 being sealed to an internal surface 132 of the ferrule 110 by a gasket 134. The ferrule turret 120 also includes a valve stem orifice 136 for enabling a valve stem 138 to extend therethrough to provide fluid communication between the interior and the exterior of the dispensing device. The operation of the dispensing device 126 should be well known to those skilled in the art and for the sake of clarity will not be further explained herein.

The peripheral rim 116 of the prior art ferrule 110 includes an inner peripheral region 141 and an outer peripheral region 142. The inner peripheral region 141 is substantially planar and extends outwardly from the central region 114. The outer peripheral region 142 is substantially annular and is established to be coaxial with the ferrule turret 120 and to be normal to the inner peripheral region 141.

Figure 16:
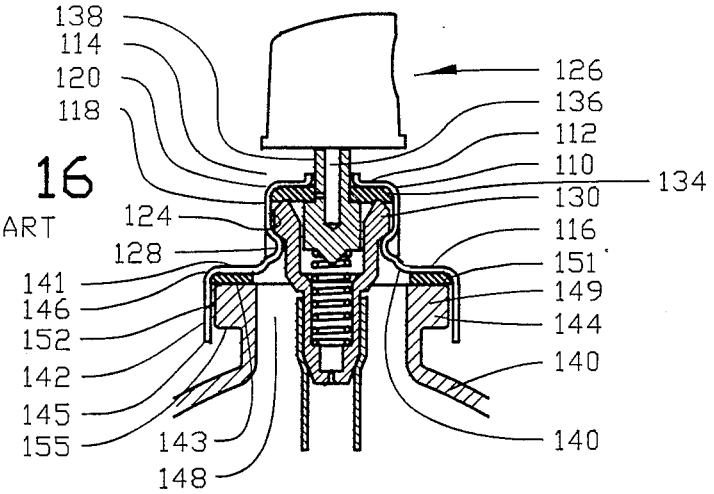
FIG. 16 PRIOR ART
FIG. 16 is a side sectional view of the prior art ferrule and ferrule valve of FIG. 15 being disposed on a container.

The juncture of the outer peripheral region 142 and the inner peripheral region 141 is slightly rounded as shown in FIGS. 15–18. The rounded juncture is formed when the ferrule is stamped from sheet metallic material. The peripheral rim 116 defines an internal space 143 for receiving an annular bead 144 of the container 140 as shown in FIG. 16. The outer peripheral region 142 terminates in an end portion 145. The interior surface 143 of the ferrule 110 is provided with a sealing gasket 146 for providing a fluid-tight seal between the peripheral rim 116 and the annular bead 144 of the aerosol container 140. The sealing gasket 146 is individually formed from a resilient material and is maintained within the internal space 143 by frictional contact with the ferrule 110 and/or the valve body 130.

The annular bead 144 extends about an opening 148 in the container 140. The annular bead 144 has an outer periphery 149 defining an inner bead surface 151 proximate the opening 148 of the container 140 and an outer bead surface 152 remote from the opening 148 in the container 140. The inner bead surface 151 is substantially planar and extends outwardly from the opening 148. The outer bead surface 152 is substantially annular and is established to be coaxial with the opening 148 and to be normal to the inner bead surface 151. The annular bead 144 has a lower crimping surface 155 being generally parallel to the inner bead surface 151. In the prior art ferrule 110, the inner peripheral region 141 and the outer peripheral region 142 is dimensioned slightly larger than the inner bead surface 141 and the outer bead surface 142 to enable the internal space 143 of the peripheral rim 116 to fully receive the annular bead 144.

FIG. 16 illustrates the prior art ferrule 110 being disposed upon the annular bead 144 of the container 140. As it can be clearly seen from FIG. 16, the inner peripheral region 141 and the outer peripheral region 142 of the peripheral rim 116 of the ferrule 110 respectively cooperate with the inner bead surface 151 and the outer bead surface 152 of the annular bead 144 of the aerosol container 140. In addition, virtually the entire internal space 143 of the peripheral rim 116 is occupied by the annular bead 144 of the container 140. Accordingly, in the prior art ferrule 110, the inner peripheral region and the outer peripheral region 141 and 142 were specifically formed to fit with the inner bead surface and the outer bead surface 151 and 152 of the annular bead 144 and to minimize any voids within the internal space 143.

Figure 17:
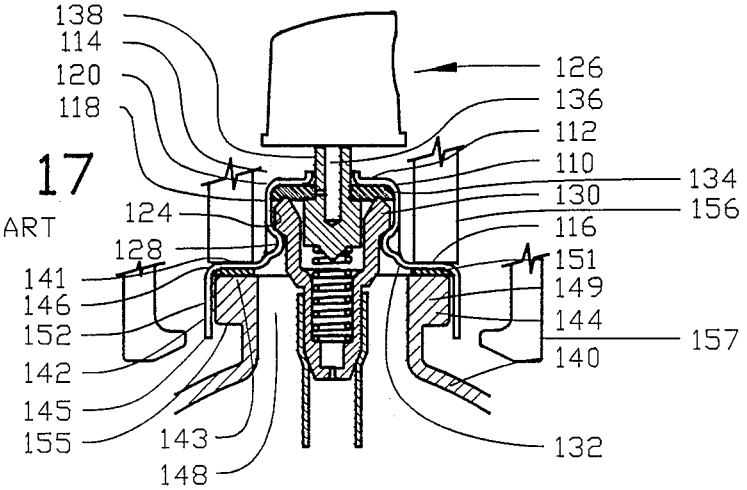
FIG. 17 PRIOR ART
FIG. 17 is a side sectional view of the prior art ferrule and ferrule valve of FIG. 15 being forced against the container.

FIG. 17 illustrates prior art ferrule 110 being depressed upon the container 140. A first collet 156 depresses the inner bead surface 141 to move the ferrule 110 downwardly thereby compressing gasket 134. Since the outer peripheral region 142 is normal to the inner peripheral region 141, the ferrule is free to move downwardly within the internal space 143 under the pressure of first collet 156 without any deformation of the ferrule 110.

Figure 18:
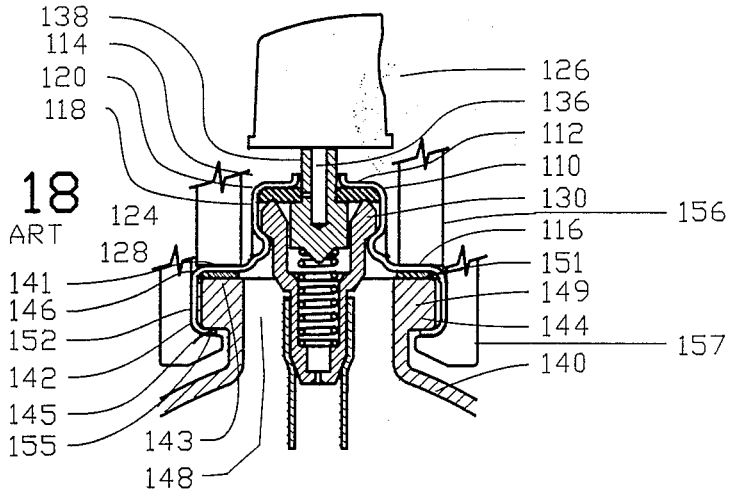
FIG. 18 PRIOR ART
FIG. 18 is a side sectional view of the prior art ferrule and ferrule valve of FIG. 15 being crimped to the container.

FIG. 18 illustrates prior art ferrule 110 being crimped to the container 140. As the first collet 156 depresses the inner bead surface 141 to compress gasket 134, a second collet 157 radially inwardly deforms or crimps the end portion 145 of ferrule 110 to engage the lower crimping surface 155 of the annular bead 144. After the end portion 145 of ferrule 110 is deformed, gasket 134 remains in a compressed condition between the inner peripheral region 141 and the inner bead surface 151 thus sealing the ferrule 110 and the container 140.

The prior art ferrule 110 has been formed in the shape as shown in FIGS. 15–18 for many years since it was believed that a fit as shown in FIG. 16 was the most advantageous to create a seal between the peripheral rim 116 and the annular bead 144. Accordingly, the majority of efforts of the prior art to improve the seal between the ferrule 110 and the container 140 were concentrated into improving the sealing gasket 146 between the peripheral rim 116 and the annular bead 144.

Figure 19:
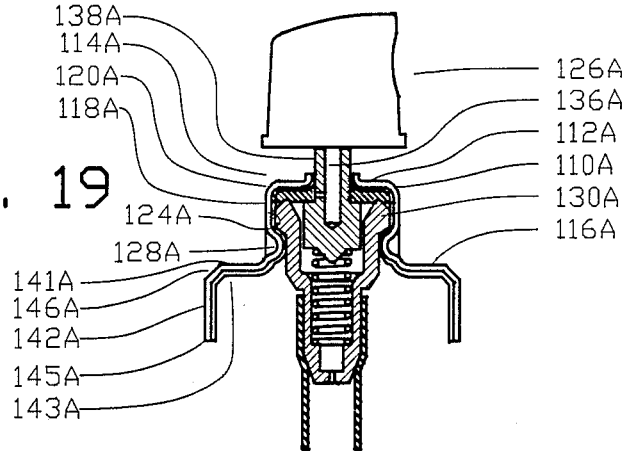
FIG. 19 is a side sectional view of an improved ferrule for a ferrule valve in accordance with the present invention.

FIG. 19 is a side sectional view of an improved ferrule 110A of the present invention having a substantially flat top 112A disposed in a central region 114A with a peripheral rim 116A being integrally connected to the top 112A by a sidewall 118A. The ferrule 110A includes a ferrule turret 120A formed in the central region 114A of the ferrule 110A. The ferrule turret 120A defines an interior cavity 124A of the turret 120A for accommodating a dispensing device 126A. In this embodiment, the dispensing device 126A is shown as an aerosol valve assembly by it should be understood that the present invention is equally applicable to other types of dispensing devices such as finger operated pumps and the like. The dispensing device 126A is crimped to the ferrule 110A by crimps 128A with a valve body 130A of the dispensing device 126A being sealed to an internal surface 132A of the ferrule 110A by a gasket 134A. The ferrule turret 120A also includes a valve stem orifice 136A for enabling a valve stem 138A to extend therethrough to provide fluid communication between the interior and the exterior of the dispensing device 126A.

The peripheral rim 116A of the ferrule 110A of the present invention includes an inner peripheral region 141A and an outer peripheral region 142A. The inner peripheral region 141A is substantially planar and extends outwardly from the central region 114A. The outer peripheral region 142A is substantially annular and is established to be coaxial with the ferrule turret 120A and to be normal to the inner peripheral region 141A. The outer peripheral region 142A terminates in an end portion 145A.

Figure 20:
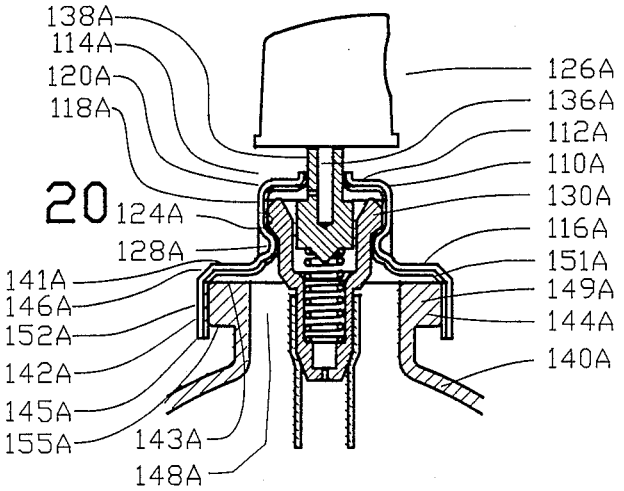
FIG. 20 is a side sectional view of the improved ferrule for a ferrule valve shown in FIG. 19 being disposed on a container.

As can be clearly seen from FIGS. 19 and 20, the peripheral rim 116A of the improved ferrule 110A is substantially different in shape from the outer periphery 149A of the annular bead 144A (FIG. 20). The peripheral rim 116A of the improved ferrule 110A extends into the interior space 143A normally defined by the peripheral rim 116A of the prior art ferrule 110 shown in FIGS. 15–18. In the embodiment shown in FIGS. 19–23, a flattened annular surface 147A having a substantially linear cross-section is interposed between the inner peripheral region 141A and the outer peripheral region 142A. The flattened annular surface 147A, or bevel, is angularly disposed relative to the inner peripheral region 141A and the outer peripheral region 142A.

In one embodiment, the bevel 147A forms an angle of approximately 30 degrees relative to the plane of the inner peripheral region 141A. Since the bevel 147A is shown as a linear tapered region, the radius of curvature of the bevel 147A is infinite but it should be understood that the bevel 147A may be slightly curved about a large radius of curvature or may be convexly curved into the interior space 143A of the peripheral rim 116A to accomplish the intended purpose of the invention.

The peripheral rim 116A defines an internal space 143A for partially receiving an annular bead 144A of the container 140A as shown in FIG. 20. In this embodiment, the interior surface of the ferrule 110A is provided with a sealing gasket 146A for providing a fluid-tight seal between the peripheral rim 116A and the annular bead 144A of the aerosol container 140A. The sealing gasket 146A is formed from a resilient material and which is bonded to the interior surface of the ferrule 110A prior to the ferrule 110A being formed into the shape as shown. In one example, sheet polyethylene material is bonded or laminated to one side of sheet metal material. The laminated sheet metal material is then passed through progressive dies to form the ferrule 110A with the sealing gasket 146A still bonded to the interior surface of the ferrule 110A. In the alternative, the sealing gasket 146A is bonded to the interior surface of the ferrule 110A after the ferrule 110A is formed into the shape as shown by an electrostatic coating process, a fluidized bead coating process or the like. The bevel 147A is formed when the ferrule 110A is stamped from sheet metallic laminated material.

FIG. 20 illustrates the annular bead 144A of the container 140A. In a manner identical to FIGS. 15–18, the annular bead 144A extends about an opening 148A in the container 140. The annular bead 144A has an outer periphery 149A defining an inner bead surface 151A proximate the opening 148A of the container 140A and an outer bead surface 152A remote from the opening 148A in the container 140A. The inner bead surface 151A is substantially planar and extends outwardly from the opening 148A. The outer bead surface 152A is substantially annular and is established to be coaxial with the opening 148A and to be normal to the inner bead surface 151A. The annular bead 144A has a lower crimping surface 155A being generally parallel to the inner bead surface 151A.

FIG. 20 also illustrates the ferrule 110A being disposed upon the container 140A with the peripheral rim 116A engaging the outer periphery of the annular bead 144A. As it can be clearly seen from FIG. 20, the bevel 147A of the peripheral rim 116A forms an interference fit with the outer periphery 149A of the annular bead 144A to inhibit the complete seating of the ferrule 110A on the annular bead 144A in contrast to the prior art shown in FIG. 16. The bevel 147A of the peripheral rim 116A allows only a portion of the ferrule 110A to contact the annular bead 144A. Accordingly, only a circular portion of the bevel 147A of the peripheral rim 116A contacts the annular bead 144A when the ferrule 110A is disposed on the aerosol container 140A. Furthermore, the internal space 143A of the improved ferrule 110A does not fully receive the annular bead 144A as did the prior art ferrule 110. In contrast to the prior art ferrule 110, a void 158A is created between the inner peripheral region 141A and the inner bead surface 141A of the annular bead 144A as shown in FIG. 20.

The interference fit between the peripheral rim 116A and the outer periphery 149A of the annular bead 144A prohibits the inner peripheral region 141A from contacting the inner bead surface 151A of the annular bead 144A.

Figure 21:
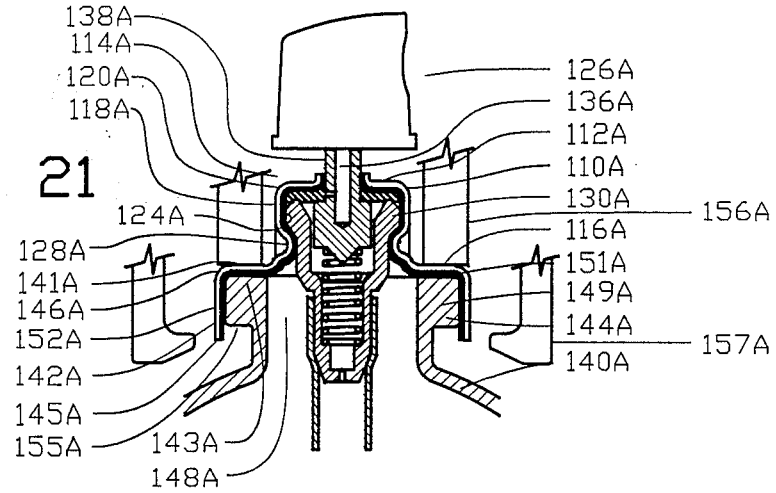
FIG. 21 is a side sectional view of the improved ferrule for a ferrule valve shown in FIG. 19 being forced into contact with a sealing bead of the container.

FIG. 21 illustrates the ferrule 110A being depressed upon the container 140A. A first collet 156A depresses the inner peripheral region 141A to move the ferrule 110A downwardly thereby reforming the bevel 147A of the peripheral rim 116A. The downward force of the first collet 156A eliminates the interference fit between the peripheral rim 116A and the outer periphery 149A of the annular bead 144A. Further downward movement of the first collet 156A moves the inner peripheral region 141A proximate the inner bead surface 151A to slightly compress the laminated gasket 146A. After depression of the ferrule 110A, the ferrule 110A is completely seated on the annular bead 144A and the internal space 143A fully receives the annular bead 144A in a manner similar to the prior art ferrule 110.

Figure 22:
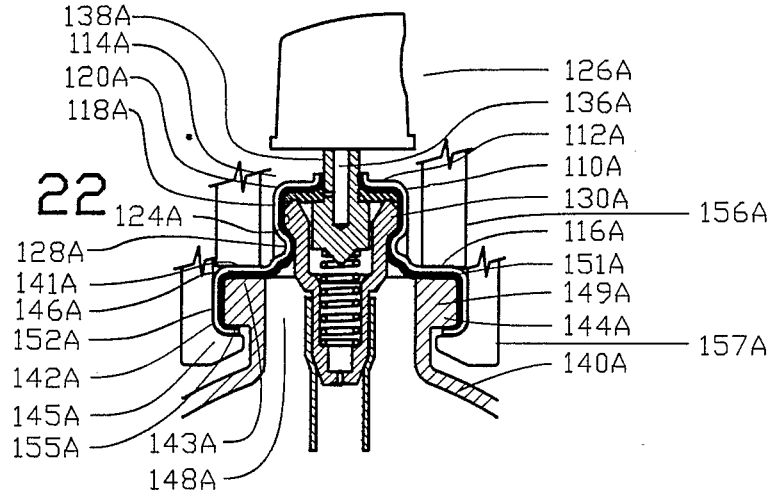
FIG. 22 is a side sectional view of the improved ferrule for a ferrule valve shown in FIG. 19 being crimped to the container.

FIG. 22 illustrates the ferrule 110A being crimped to the container 140A. While the first collet 156A depresses the inner peripheral region 141A, a second collet 157A radially inwardly deforms or crimps the end portion 145A of ferrule 110A to engage the lower crimping surface 155A of the annular bead 144A. After the end portion 145A of ferrule 110A is deformed, gasket 146A remains in a compressed condition between the inner peripheral region 141A and the inner bead surface 151A thus sealing the ferrule 110A and the container 140A.

Figure 23:
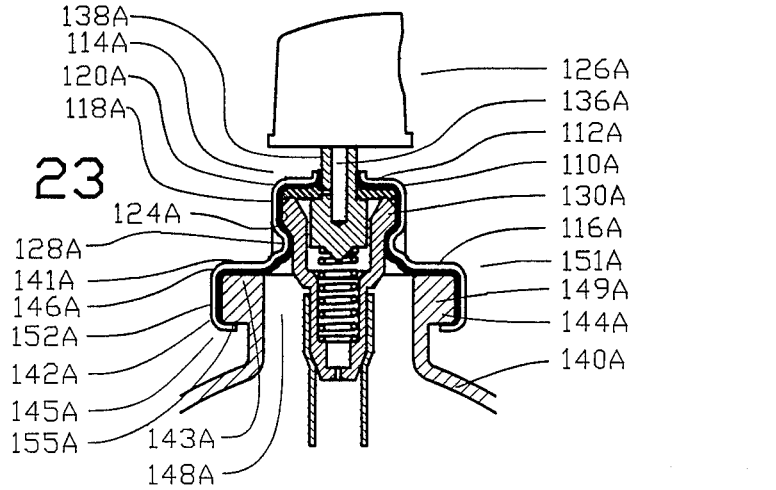
FIG. 23 is a side sectional view the improved ferrule for a ferrule valve shown in FIG. 19 completely crimped to the container.

FIG. 23 illustrates the ferrule 110A being sealed to the container 140A after removal of the first and second collets 156A and 157A. As it can be seen from an examination of FIGS. 23 and 18, the outward appearance of the peripheral rim 116A of the improved ferrule 110A of the present invention is substantially the same as the outward appearance of the peripheral rim 116 of the prior art ferrule 110. Accordingly, after crimping of the improved ferrule 110A, the ferrule 110A appears to be identical to the prior art ferrule 110 to the casual observer.

In the prior art process, the peripheral rim 116 of the ferrule 110 is formed to completely contact with the annular bead 144 as shown in FIG. 16. In the event of a significant variation in the size or the shape of the peripheral rim 116 and/or the annular bead 144, a void is produced in the seal between the peripheral rim 116 and the annular bead 144. During the crimping of the prior art ferrule 110, there is only little downward movement of the peripheral rim 116 relative to the annular bead 144. Thus leaks may develop between the peripheral rim 116 and the annular bead 144 at the point or points of the significant variation in the size or the shape of the peripheral rim 116 and/or the annular bead 144.

In the improved ferrule 110A of the present invention, the peripheral rim 116A inhibits the peripheral rim 116A from completely contacting the annular bead 144A in contrast to the prior art ferrule 110. The downward movement of the ferrule 110A deforms the peripheral rim while moving the peripheral rim into tight engagement with the annular bead 144. The deformation process of the improved ferrule 110A compensates for any variations in the size or the shape of the peripheral rim 116A and/or the annular bead 144A since the entire bevel 146A is selectively deformed during the process. Accordingly, the peripheral rim 116A may be deformed to a greater degree or a lesser degree at the point or points of the significant variation in the size or the shape of the peripheral rim 116A and/or the annular bead 144A. In contrast, the prior art sealing process relied on a complete and uniform contact of the peripheral rim 116 of the ferrule 110 to the annular bead 144 prior to the crimping process. Thereafter, the prior art ferrule was uniformly crimped without regard for any significant variation in the size or the shape of the peripheral rim 116 and/or the annular bead 144. The bevel 146A of the peripheral rim 116A functions as a wedge during the process whereby the collets 156A and 157A will deform and draw down the peripheral rim 116A of the ferrule 110A into sealing engagement with the annular bead 144A of the container 140A. During the process, the annular bead 144A of the container 140A functions as a fulcrum to reform the peripheral rim 116A. After the crimping process is completed, the peripheral rim 116A remains in tight intimate contact with the annular bead 144A of the container 140A regardless of any nominal manufacturing variations that may be present in the peripheral rim 116A and/or the annular bead 144A of the container 140A.

The present invention has been found useful with virtually any presently available dispensing devices incorporating a ferrule as well as numerous types of cans or containers having an annular bead 144. The present invention also provides superior seals on containers constructed of different types of materials including but not limited to ferrous and non-ferrous metals as well as glass and plastic containers. The present invention also enables a laminated gasket to be utilized with a ferrule as heretofore unknown in the art.

The present disclosure comprises the forgoing specification and drawings and the appended claims. Although this invention has been described in the preferred form with a certain degree of particularity, it should be understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. An improved ferrule for sealing with a container of a dispensing device, the container having an annular bead extending about an opening in the container with the annular bead having an outer bead periphery defining an inner bead surface and an outer bead surface, the inner bead surface being generally planar and with the outer bead surface being generally annular and with the outer bead surface being established generally normal to the inner bead surface, comprising in combination:

a ferrule comprising a central region and a peripheral rim;

said central region of said ferrule being established for receiving the dispensing device for providing controlled fluid flow between the interior and exterior of the container; said peripheral rim of said ferrule extending outwardly of said central region;

said peripheral rim of said ferrule having an inner peripheral region being generally planar and located proximate said central region;

said peripheral rim of said ferrule having an outer peripheral region being generally annular and located remote said central region;

said outer peripheral region of said ferrule being established generally normal to the said planar inner peripheral region of said ferrule;

said inner peripheral region and said outer peripheral region of said ferrule being established for cooperating with the inner bead surface and the outer bead surface of the container;

a bevel integrally formed in said ferrule between said inner peripheral region and said outer peripheral region for inhibiting said inner peripheral region of said ferrule from fully contacting the inner bead surface of the annular bead of the container when said ferrule is disposed upon the container;

said bevel of said ferrule being deformed when said ferrule is sealed to the annular bead of the container to approximate the general shape of the outer bead periphery of the annular bead and to move said inner peripheral region of said ferrule proximate the inner bead surface to provide a sealing engagement between said ferrule and the container.

2. An improved ferrule for sealing with a container of a dispensing device as set forth in claim 1, wherein said bevel is established at an acute angle relative to said inner bead surface of said peripheral rim of said ferrule.

3. An improved ferrule for sealing with a container of a dispensing device as set forth in claim 1, wherein said deformation of said bevel is accomplished by a compression of said peripheral rim upon the annular rim of the container.

4. An improved ferrule for sealing with a container of a dispensing device as set forth in claim 1, wherein said deformation of said bevel is accomplished by a downward compression of said peripheral rim upon the annular rim of the container and an inward compression of a portion of said peripheral rim.

5. An improved ferrule for sealing with a container of a dispensing device as set forth in claim 1, including a gasket material bonded to an interior surface of said ferrule for assisting the seal between said ferrule and the container.

6. An improved ferrule for sealing with a container of a dispensing device as set forth in claim 5, wherein said gasket material is bonded to an interior surface of said ferrule prior to the formation of said ferrule.

7. An improved ferrule for sealing with a container of a dispensing device, the container having an annular bead extending about an opening in the container with the annular bead having an outer bead periphery, comprising in combination:

a ferrule formed from a sheet material to have a central region and a peripheral rim;

a gasket material bonded to an interior surface of said ferrule prior to the formation of said ferrule;

said central region of said ferrule being established for receiving the dispensing device for providing controlled fluid flow between the interior and exterior of the container;

said peripheral rim of said ferrule extending outwardly of said central region;

said peripheral rim of said ferrule having an inner peripheral region being located proximate said central region and having an outer peripheral region being located remote said central region;

said peripheral rim having a flattened annular surface extending between said inner peripheral region and said outer peripheral region;

said flattened annular surface of said ferrule extending radially inwardly relative to said outer peripheral region to allow only partial insertion of said ferrule upon the annular bead of the container; and said flattened annular surface of said ferrule being re formed to be substantially the same as the outer bead periphery of the annular bead to provide a sealing engagement between said ferrule and the container when said ferrule is crimped to the annular bead of the container.

8. An improved ferrule for sealing with a container of a dispensing device as set forth in claim 7, wherein said flattened annular surface is established at an acute angle relative to said outer peripheral region of said peripheral rim of said ferrule.

9. An improved ferrule for sealing with a container of a dispensing device as set forth in claim 7, wherein said deformation of said flattened annular surface during said crimping of said ferrule to the container being accomplished by a downward compression of said peripheral rim upon the annular rim of the container and the application of an inwardly directed external force exerted upon a portion of said peripheral rim and void of any outward external force being applied to said ferrule.

10. An improved ferrule for sealing with a container of a dispensing device, the container having an annular bead extending about an opening in the container with the annular bead having an outer bead periphery defining an inner bead surface and an outer bead surface, the inner bead surface being generally planar and with the outer bead surface being generally annular and with the outer bead surface being established generally normal to the inner bead surface, comprising in combination:

a ferrule comprising a central region and a peripheral rim;

said central region of said ferrule being established for receiving the dispensing device for providing controlled fluid flow between the interior and exterior of the container;

said peripheral rim of said ferrule extending outwardly of said central region;

said peripheral rim of said ferrule having an inner peripheral region being generally planar and located proximate said central region;

said peripheral rim of said ferrule having an outer peripheral region being generally annular and located remote said central region;

said annular outer peripheral region of said ferrule being established generally normal to the said planar inner peripheral region of said ferrule;

a gasket bonded to said inner peripheral region of said ferrule;

said outer peripheral region of said peripheral rim having a portion thereof having a contour different from said outer peripheral bead of the annular bead of the container;

said different contour portion of said outer peripheral region being established for engaging the outer bead peripheral of the annular bead of the container to inhibit said inner peripheral region of said peripheral rim of said ferrule from fully contacting the inner bead surface of the annular bead of the container when said ferrule is disposed upon the container; and said different contour portion of said outer peripheral region of said ferrule being deformed when said ferrule is sealed to the annular bead of the container to approximate the cross-section of the outer bead peripheral of the annular bead and to move the inner peripheral region of said peripheral rim into full contact with the inner bead surface of the annular bead to provide a sealing engagement between said ferrule and the container.

11. An improved ferrule for sealing with a container of a dispensing device, the container having an annular bead extending about an opening in the container with the annular bead having an outer bead periphery defining an inner bead surface and an outer bead surface, comprising in combination:

a ferrule comprising a central region and a peripheral rim;

said peripheral rim of said ferrule extending outwardly of said central region;

said peripheral rim of said ferrule having an inner peripheral region being located proximate said central region and having an outer peripheral region being located remote said central region;

said outer peripheral region of said peripheral rim having a portion thereof having a contour different from said outer bead periphery of the annular bead of the container;

said different contour portion of said outer peripheral region inhibiting said inner peripheral region of said peripheral rim from fully contacting the inner bead surface of the annular bead of the container when said ferrule is disposed upon the container; and said different contour portion of said outer peripheral region being deformed when said ferrule is sealed to the annular bead of the container to have substantially the same contour as the outer bead periphery of the annular bead and to move the inner peripheral region of said peripheral rim into full contact with the inner bead surface of the annular bead to provide a sealing engagement between said ferrule and the container.

12. An improved ferrule for sealing with a container of a dispensing device as set forth in claim 11, including a gasket material bonded to an interior surface of said ferrule for assisting the seal between said ferrule and the container.

13. A preformed ferrule for sealing with a container of a dispensing device, the container having an annular bead extending about an opening in the container with the annular bead defining an inner bead surface proximate the opening in the container and an outer bead surface remote from the opening in the container, comprising:

a ferrule comprising a central region and a peripheral rim;

said peripheral rim of said ferrule extending outwardly of said central region;

said peripheral rim of said ferrule having an inner peripheral region being located proximate said central region and having an outer peripheral region being located remote said central region;

said ferrule being dimensionally preformed for providing an interference fit between said peripheral rim and the annular bead of the container to inhibit said inner peripheral region of said peripheral rim of said ferrule from sealing with the inner bead surface of the annular bead of the container;

said ferrule being deformed to move said inner peripheral region of the peripheral rim into sealed contact with the inner bead surface of the annular bead when the ferrule is sealed to the annular bead of the container.

14. An improved ferrule for sealing with a container of a dispensing device, the container having an annular bead extending about an opening in the container, comprising in combination:

a ferrule comprising a central region and a peripheral rim;

said peripheral rim of said ferrule extending outwardly of said central region;

said peripheral rim of said ferrule having an inner peripheral region being located proximate said central region and having an outer peripheral region being located remote said central region;

said ferrule having a radially inwardly contracted portion for providing an interference fit with the annular bead of the container to allow only partial insertion of said ferrule upon the annular bead of the container and for inhibiting said peripheral rim from matingly engaging with the annular bead of the container; and said radially inwardly contracted portion of said ferrule being deformed to eliminate said interference fit with the annular bead to provide a sealing engagement between said ferrule and the container when said ferrule is crimped to the annular bead of the container.

15. An improved ferrule for sealing with a container of a dispensing device as set forth in claim 14, including a gasket material bonded to an interior surface of said ferrule for assisting the seal between said ferrule and the container.

16. An improved ferrule for sealing with a container of a dispensing device as set forth in claim 15, wherein said reforming of said contracted portion during crimping enabling said ferrule to be completely inserted upon the annular bead of the container and causing said peripheral rim to be moved into matingly engagement with said annular bead of the container.

17. The method of sealing a ferrule to a dispensing container where the container has an annular bead extending about an opening in the container with the annular bead having an outer bead periphery defining an inner bead surface and an outer bead surface, the ferrule having a central region and a peripheral rim, the central region being established for receiving the dispensing device for providing controlled fluid flow between the interior and exterior of the container and the peripheral rim extending outwardly of the central region and having a bevel formed therein, the method comprising the steps of:

placing the ferrule on the dispensing container so that the bevel engages the outer bead surface thereby preventing the ferrule for mating properly with the annular bead;

forcing the peripheral rim of the ferrule against the annular bead thereby reforming the bevel to exactly fit the shape of the annular bead so that the ferrule mates properly with the annular bead; and forcing an inward crimp in the ferrule to thereby hold the ferrule in proper mating relationship with the annular bead.

18. The method of sealing a ferrule to a dispensing container as set forth in claim 17, wherein the forcing steps each are controlled by pressure applied by external collets.

* * * * *